US005316511A

United States Patent [19]

Lee

[11] Patent Number: 5,316,511

[45] Date of Patent: May 31, 1994

[54] METHOD FOR MAKING A SILICON FIELD EMISSION DEVICE

[75] Inventor: Kangok Lee, Kyunggi, Rep. of Korea

[73] Assignee: Samsung Electron Devices Co., Ltd., Rep. of Korea

[21] Appl. No.: 25,094

[22] Filed: Mar. 2, 1993

[30] Foreign Application Priority Data

Nov. 25, 1992 [KR] Rep. of Korea ..... 92-22357

[51] Int. Cl.[5] ..... H01J 9/02

[52] U.S. Cl. ..... 445/24; 445/50

[58] Field of Search ..... 445/24, 50; 313/309

[56] References Cited

U.S. PATENT DOCUMENTS 4,210,689 7/1980 Komatsu ..... 437/162
4,663,559 5/1987 Christensen ..... 313/336
5,130,266 7/1992 Huang et al. ..... 437/41 X

FOREIGN PATENT DOCUMENTS 508737 10/1992 European Pat. Off. ..... 445/50

OTHER PUBLICATIONS

"Oxidation-Sharpened Gated Field Emitter Array Process"; 1991 IEEE, pp. 2389-2391; McGruer, Warner, Singhal, Gu, Chan.

*Primary Examiner*—Kenneth J. Ramsey
*Attorney, Agent, or Firm*—Christie, Parker & Hale

[57] ABSTRACT

This invention discloses a method for making a silicon field emission device which ensures in the higher electron emission effect at the same voltage required for field emission by shrinking the diameter of a gate aperture to make the field emission structure sharp. The shrinkage effect of the gate aperture of about 42-45% may be achieved in accordance with this invention.

1 Claim, 6 Drawing Sheets

METHOD FOR MAKING A SILICON FIELD EMISSION DEVICE

BACKGROUND OF THE INVENTION (1) Field of the Invention

The present invention relates to a silicon field emission device. More particularly, it relates to a method for making an improved silicon field emission device to emit electrons at a little lower voltage by reducing the diameter of a gate aperture between a gate electrode and a silicon emitter to make the field emission structure sharp.

This field emission device may be utilized as an electron source in various display elements, light sources, amplifying devices, high speed switching devices, or sensors.

(2) Description of the Related Art

As a display monitor that can be substituted for a conventional cathode ray tube of a television, flat panel displays for wall television sets such as liquid crystal displays, plasma display panel, field emission device have received living study. The field emission device may have very high luminous efficiency and luminance by making unit pixed, i.e. the emitters per pixel high-integrated to $10^4$–$10^5$ tips/$MM^2$, and is thought as a very suitable display for the embodiment of wall television sets.

Besides, even though silicon has a low electric conductivity and melting point, the applicability is gradually increased by the variety of the microfabrication technology that can facilitate fabrication of sharp emitter tips by means of silicon.

A representative embodiment of a structure of this silicon field emission device is depicted in FIG. 6. The reference numeral 60 designates a silicon substrate doped with impurities of high density to have a high conductivity. In a gate aperture 68 formed within insulating layers 62, 64 made on this substrate 60, an emitter 65 is formed to be united with the silicon substrate, serving as an electron emission part. And, a gate electrode 66 formed of molybdenum to enclose the emitter 65, with each space being of a predetermined width, is deposited on the insulating layer 64.

FIG. 8 depicts a perspective view of a conventional display using the electron emission device.

Referring to FIG. 8, there are formed a silicon substrate doped with impurities of high density and united with conic field emission emitters 65 in accordance with the direction of rows 81 and an insulating layer 64. In addition, a plurality of gate electrodes 66 is formed on the insulating layer 64 in accordance with the direction of columns 83. Gate apertures 68 are formed at a position corresponding to the gate electrodes 66 and the conic field emission emitters 65. On an upper substrate 90, a transparent conductive layer 92 and a fluorescent layer 94 are respectively deposited to be fixed to the upper substrate in a beta configuration. The lower substrate 60 and the upper substrate 90 form side members and an external part of a vacuum tube (not illustrated).

The operation of the display mentioned above is as follows.

Positive potential is applied to the transparent conductive layer 92. Responsive to a display signal, a predetermined potential difference is given between the silicon emitters 65 in the rows and the gate electrodes 66 in the columns. An appropriate electric field is produced between them such that electrons are emitted from the conic emitters 65. The electrons are emitted through the gate apertures 68 and collide with the fluorescent layer 94, and this fluorescent layer 94 radiates.

For example, by biasing the gate electrodes 66 within the range of several 10 V to several 100 V to the substrate 60, an electric field is produced between the conic tips of the emitters 65 having a microscopic diameter and the gate electrodes 66, and the electron emission of about several hundreds mA is achieved from the tips of the emitters 65.

In the field emission device for displaying a picture according to a display signal by the above operation, the gate aperture 68 is preferably small in diameter to improve the electron emission characteristics, i.e. to obtain the low voltage-driving condition.

When it comes to a real fabrication procedure, however, the insulating layer 64 and the gate electrodes 66 are deposited slantingly because of the limit to the deposition angle (under 90 degrees), and the gate aperture is apt to be enlarged in diameter. This occasions the increase of the gate voltage and difficulty in the low voltage-driving.

FIG. 7 depicts an enlarged sectional view of the step for depositing a gate prior to lift-off of an oxide mask and an oxide film underneath the oxide mask after the step for depositing the gate insulating layer 64 and the gate electrodes 66, in order to describe in detail the above problems. Since the gate electrode 66 and the insulating layer 64 are deposited slantingly according to a deposition angle $\alpha$, the oxide mask 63 is extended, and its profile is formed to be fan shaped under 10 degrees. Accordingly, this causes a side effect that the diameter of the gate aperture actually formed is more enlarged than the one in a design drawing.

SUMMARY OF THE INVENTION

An object of this invention is to provide a method for making a silicon field emission device which ensures in the higher electron emission effect at the same voltage required for field emission by minimizing the diameter of a gate aperture to make the field emission structure sharp.

To attain this object, a method for making a silicon field emission device in accordance with this invention comprises the steps of:

- forming thermal oxide masks by photo-etching after thermal oxidation of a high density silicon substrate;
- dry-etching the silicon substrate to form conical emitters by means of the thermal oxide masks;
- carrying out a thermal oxidation process to form the plane emitters to have sharp tips;
- forming insulating films self-aligned through the masks;
- carrying out a densification process at a high temperature to shrink each thickness of the masks and insulating films in the vertical and horizontal directions;
- forming gate electrodes to enclose one part of the insulating films by depositing a gate metal layer on the insulating films having the thickness shrank through the process sequence; and
- carrying out lift-off to remove simultaneously the upper layers including the mask.

As a condition of the densification, the densification process is performed in the range of 900° C. to 950° C. and in high purity nitrogen and/or oxygen ambient.

BRIEF DESCRIPTION OF THE DRAWINGS

This invention can be more fully understood from the following detailed description when taken in conjunction with the accompanying drawings, wherein.

DESCRIPTION OF THE PREFERRED EMBODIMENTS

FIGS. 3A to 3F depict the steps in the manufacture of an emitter 15 having a microscopic tip in accordance with the present invention.

Figure 1:
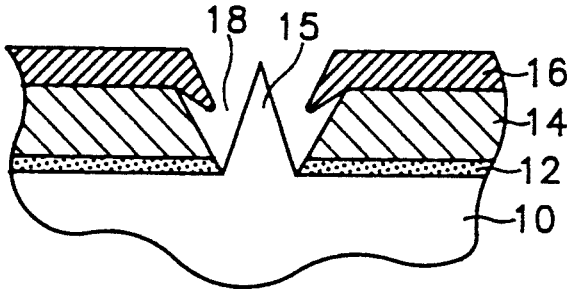
FIG. 1 is a sectional view of a silicon field emission device.

A first step is to form oxide masks 13 (FIG. 1). A single crystalline substrate 10, e.g. n-type silicon substrate having resistivity of several Ω cm is thermally oxidized to form an oxide film of about 1200 angstroms, and the oxide masks 13 for self-alignment at the time of the following etching process and deposition process are then formed through photo-etching.

Figure 3A:
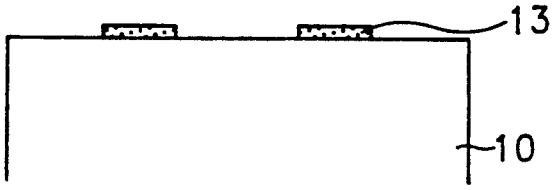
FIGS. 3A to 3F depict the steps in the manufacture of a field emission device in accordance with the present invention.
Figure 3B:
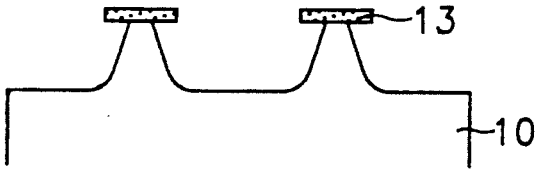

A second step is etching the silicon substrate by reactive ion etching to allow control of the emitter aspect ratio and form conical emitters by means of the oxide masks 13 (FIG. 3B). The single crystalline substrate 10 made of silicon under the oxide masks 13 is selectively etched in the horizontal and vertical directions at a predetermined rate. The configuration of the silicon emitters having sharp conical edges (i.e. tips) is determined by the selective etch rate and the shape of the mask, which gives a depth-to-undercut ratio of 4:1, preferably.

Figure 3C:
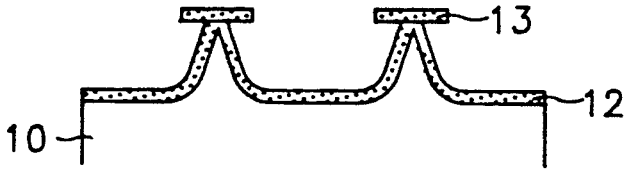

A third step is a second thermal oxidation process, and the surface of the substrate 10 is oxidized in order to form the plane tips of the silicon emitters to be sharp. The profile of the oxide film 12 grown underneath the oxide masks 13 is the same as the selective etching profile, as shown in FIG. 3C, and in the final process, the oxide film 12 is removed to remain the sharp profile of the silicon emitters.

Figure 3D:
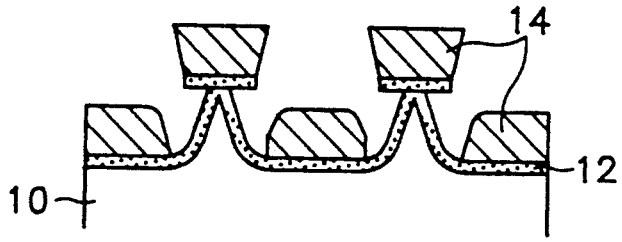

In a fourth step, after insulating films 14 are deposited by means of the oxide masks 13, each thickness and width of the oxide masks 13 and the insulating films 14 is reduced by carrying out a densification process in high purity nitrogen and/or oxygen ambient and at a high temperature of over 600° C. (FIG. 3D). The reason why each thickness and width of them is reduced by the densification process is caused by the following mechanism. The insulating films after electron-beam evaporation consist of unstable $SiO_X$, (almost SiO) in which Si and $O_2$ are not completely joined with each other. Thus, the grain size of the excessive Si that is not joined with $O_2$ and left as a dangling bond, is changed and stabilized by applying heat, with infusing high purity gas. At this point, the stability in the exterior surface of the oxide masks 13 and the insulating films 14 is achieved by the high purity gas, and as the lattice is realigned by the heat of high temperatures in the interior, its width and the thickness are shrunk.

As a result, the vertical-to-horizontal shrinkage is approximately in the ratio of 2:1, and the greater shrinkage effect can be achieved in nitrogen ambient rather than in oxygen ambient. The optimal temperature of the densification process is in the range of 900° to 950° C.

Figure 3E:
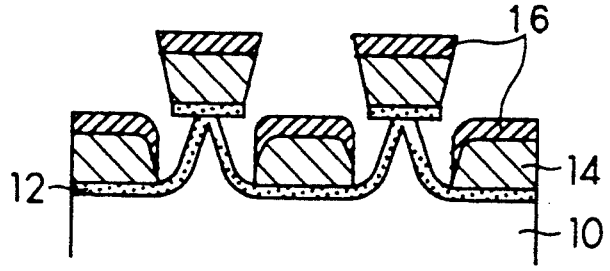

A fifth step is to form gate electrodes in "—" shape to enclose one part of the insulating films by depositing a gate metal layer on the insulating films 14 (FIG. 3E).

Figure 3F:
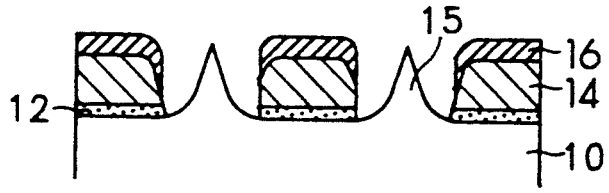

As a final step, after the oxide masks 13 and the oxide film 12 are removed by lift-off, the silicon field emission device is completely formed, as shown in FIG. 3F or FIG. 1.

Figure 2:
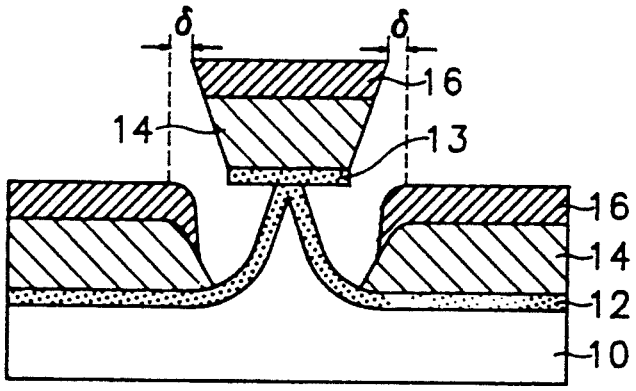
FIG. 2 depicts a process for depositing gate electrodes in the fabrication process sequence of the silicon field emission device of FIG. 1.

FIG. 2 is a sectional view showing the shrinkage of the oxide film after the densification process, and as the thickness of the width of the oxide film 14 are reduced by δ, the gate aperture is decreased by 2δ in diameter, substantially.

The fabrication of the field emission display is completed by manufacturing the upper substrate in the above-described manner and making the interior of the panel vacuous after sealing airtightly the upper substrate, the lower substrate and the side members with a fritt paste.

The operation of the display manufactured through the above process sequence is as follows.

Responding to electric display signals, a predetermined potential difference is given between a plurality of the emitters arranged in row and the gate electrodes formed in column to drive the pixels or the conic emitters, and the electrons emitted from predetermined pixels collide with corresponding fluorescent layers in such a manner that visual images are displayed in the screen. The above potential difference generally maintains to about 80 volts, and voltage of about 200 V may be applied to a transparent conductive film.

Figure 4:
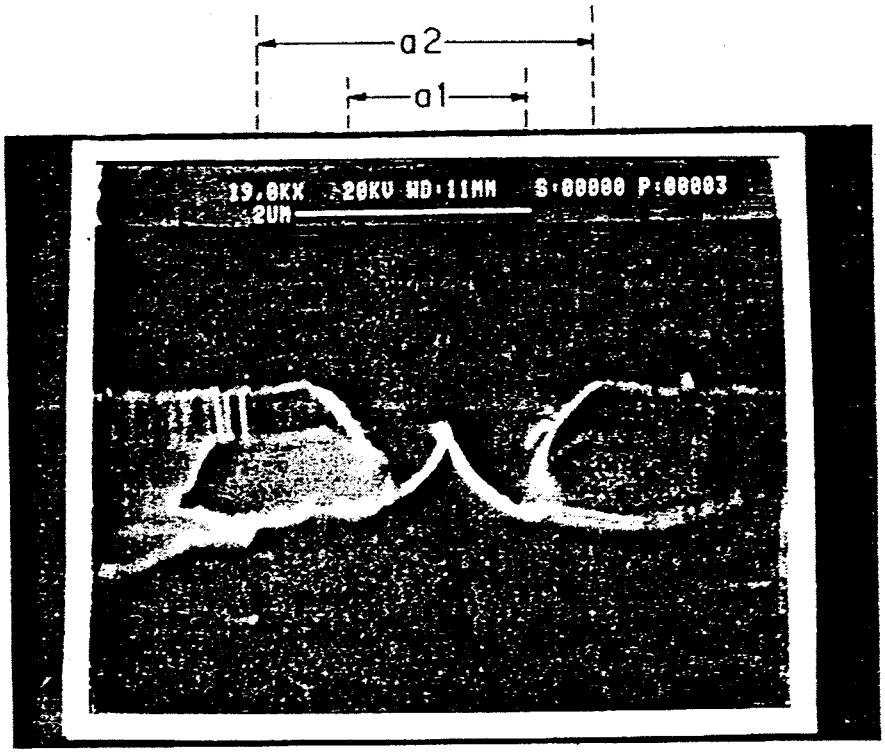
FIG. 4 is a sectional view of SEM microphotograph for the field emission device in accordance with the present invention.
Figure 5:
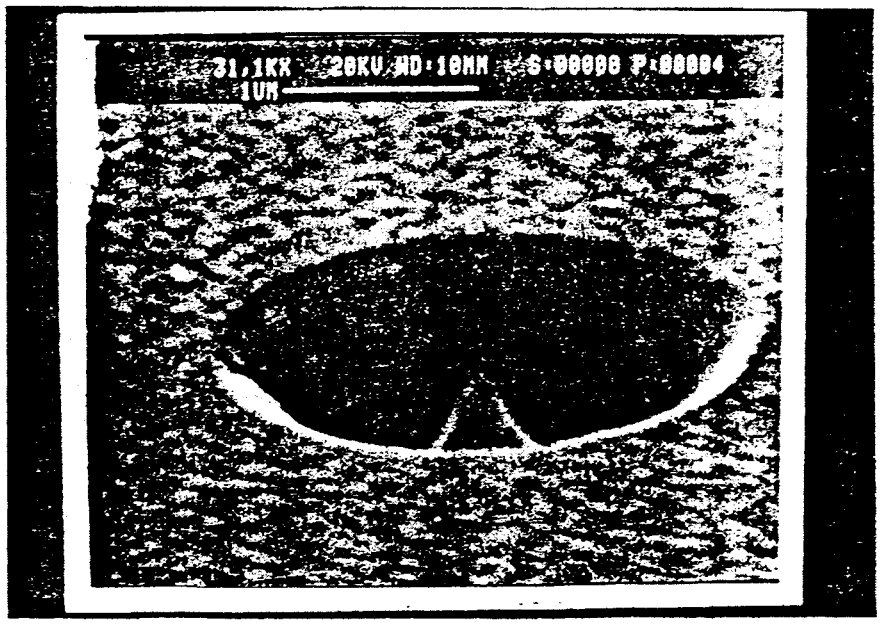
FIG. 5 is a perspective view of SEM microphotograph for the field emission device in accordance with the present invention.
Figure 6:
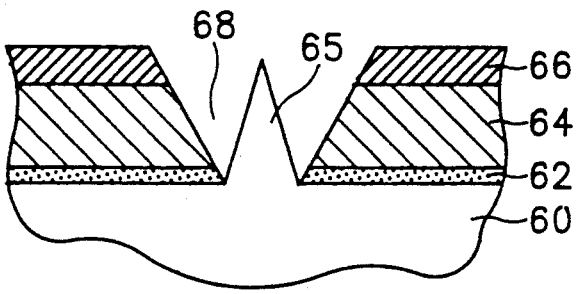
FIG.6 (Prior Art)
FIG. 6 is a sectional view of a conventional silicon field emission device.
Figure 7:
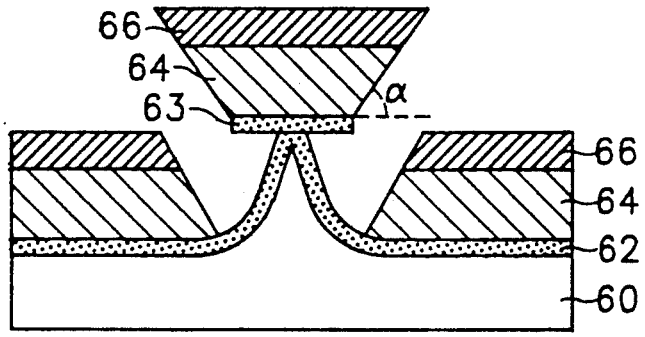
FIG.7 (Prior Art)
FIG. 7 depicts a process for depositing gate electrodes in the fabrication process sequence of the silicon field emission device shown in FIG. 6.
Figure 8:
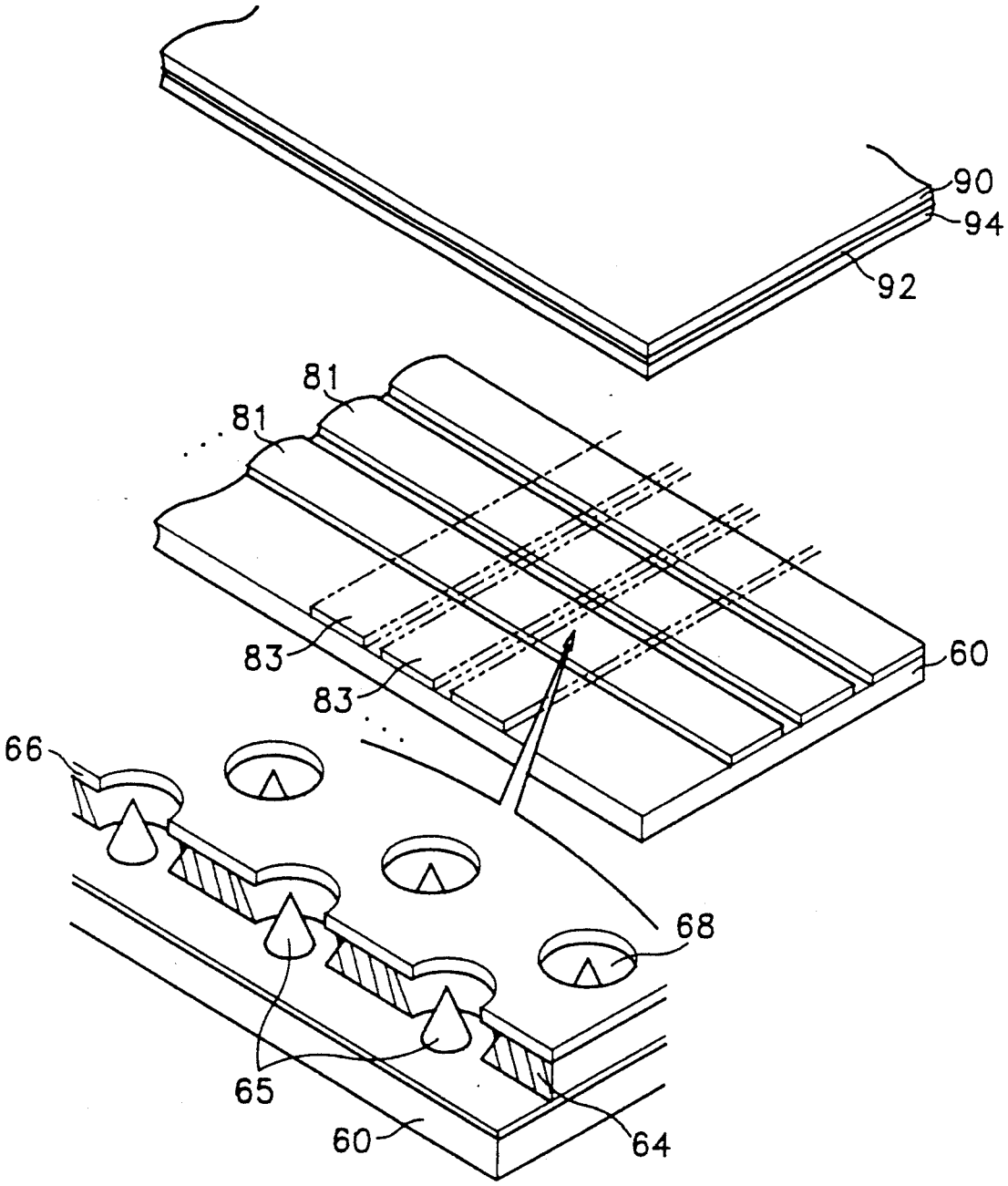
FIG.8 (Prior Art)
FIG. 8 is a perspective view depicting the structure of a display using the field emission device of FIG. 6.

The effect of this invention is definitely shown in the SEM microphotographs of the field emission device in accordance with the present invention (FIGS. 4 and 5). FIG. 4 shows a sectional view of the SEM microphotograph for the field emission device of this invention, and FIG. 5 shows a perspective view of the SEM microphotograph for the field emission device tilted at an angle of 60 degrees. Reference letter $a_1$ designates the diameter of the gate aperture decreased in accordance with this invention, and $a_2$ designates the diameter of the gate aperture enlarged in a conventional manner.

The diameter β of the gate aperture decreased in accordance with this invention is:

$$\beta = a_2 - a_1 = 2\delta = 2.2 - 1.2 = 1.0\ \mu m$$

Accordingly, the shrinkage effect of the gate aperture of about 42–45% may be achieved in accordance with this invention.

What is claimed is:

1. A method for making a silicon field emission device comprising the steps of:

forming thermal oxide masks by photo-etching after thermal oxidation of a high density silicon substrate;

carrying out reactive ion etching on said silicon substrate to form conical emitters by means of said thermal oxide masks;

carrying out a thermal oxidation process to form said plane emitters to have sharp tips;

forming insulating films self-aligned through said masks;

carrying out a densification process at a high temperature to shrink each thickness of said masks and insulating films in the vertical and horizontal directions;

forming gate electrodes to enclose one part of said insulating films by depositing a gate metal layer on said insulating films having the thickness shrank through said process sequence; and carrying out lift-off to remove simultaneously said upper layers including said mask.

* * * * *